US008931224B2

(12) United States Patent
Schouten

(10) Patent No.: US 8,931,224 B2
(45) Date of Patent: Jan. 13, 2015

(54) LATH ASSEMBLY FOR A SIDEWALL FINISHING OF A FLOOR OR CEILING

(71) Applicant: Winnovation B.V., Apeldoorn (NL)

(72) Inventor: Aart Schouten, Apeldoorn (NL)

(73) Assignee: Winnovation B.V., Apeldoorn (NL)

( * ) Notice: Subject to any disclaimer, the term of this patent is extended or adjusted under 35 U.S.C. 154(b) by 0 days.

(21) Appl. No.: 13/934,742

(22) Filed: Jul. 3, 2013

(65) Prior Publication Data

US 2014/0007531 A1 Jan. 9, 2014

Related U.S. Application Data

(60) Provisional application No. 61/727,395, filed on Nov. 16, 2012.

(30) Foreign Application Priority Data

Jul. 5, 2012 (NL) ..... 2009134

(51) Int. Cl.
*E04B 2/00* (2006.01)
*E04F 13/073* (2006.01)
*E04F 19/04* (2006.01)

(52) U.S. Cl.
CPC ..... *E04F 13/0733* (2013.01); *E04F 19/0468* (2013.01); *E04F 19/0495* (2013.01)
USPC ..... 52/287.1; 52/288.1

(58) Field of Classification Search
USPC ..... 52/287.1, 288.1
See application file for complete search history.

(56) References Cited

U.S. PATENT DOCUMENTS

| | | | | |
|---|---|---|---|---|
| 1,250,594 | A | 12/1917 | Knapp | |
| 5,359,817 | A * | 11/1994 | Fulton | 52/288.1 |
| 8,534,016 | B2 * | 9/2013 | DePaul | 52/288.1 |
| 2005/0155312 | A1 | 7/2005 | Friday | |

FOREIGN PATENT DOCUMENTS

| | | | |
|---|---|---|---|
| EP | 1808548 | A1 | 7/2007 |
| WO | 2006122346 | A1 | 11/2006 |

OTHER PUBLICATIONS

Search Report in Corresponding EP Aplication No. 13175135.6, dated Oct. 28, 2013.
Search Report issued in corresponding Priority Application EP No. 2009134, dated May 7, 2012.

* cited by examiner

*Primary Examiner* — Mark Wendell
(74) *Attorney, Agent, or Firm* — Banner & Witcoff, Ltd.

(57) ABSTRACT

Lath assembly for a sidewall finishing of a floor or ceiling comprising a pair of a first and second lath. The lath assembly further comprises a connector for connecting the first ends of the pair of laths to each other. The connector comprises two key members which are arranged to be inserted into respective keyways of the laths to be connected. By inserting the key members into the keyways, the laths are brought into an assembled condition. Each keyway of the combination of laths comprises an integrally formed lath stopper and each key member comprises an integrally formed key stopper. The key stopper is in an assembled condition in form closure with the lath stopper to lock the connector in the longitudinal direction to the lath. Advantageously, the engagement of the key stopper with the lath stopper provides a secure lockage of the connector to the lath in length direction.

21 Claims, 12 Drawing Sheets

LATH ASSEMBLY FOR A SIDEWALL FINISHING OF A FLOOR OR CEILING

CROSS-REFERENCE TO RELATED APPLICATIONS

The present application claims priority to U.S. Provisional Application No. 61/727,395 filed Nov. 16, 2012, and to Netherlands Application No. 2009134, filed Jul. 5, 2012. The entire contents of which are incorporated herein by reference as an example embodiment.

FIELD OF THE INVENTION

The invention relates to a lath assembly for a sidewall finishing of a floor or ceiling. The lath assembly may provide an ornamental finishing of an edge, in particular a corner edge, of a floor or ceiling with respect to the sidewall. The lath assembly comprises a pair of a first and second lath. Each lath comprises a longitudinal body having a first end which is provided with a keyway. The lath assembly further comprises a connector for connecting the first ends of the pair of laths to each other. The connector comprises two key members which are arranged to be inserted into the respective keyways of the laths to be connected. Initially, the lath assembly is provided in an unassembled condition. By inserting the key members into the keyways, the laths may be brought into an assembled condition.

SUMMARY OF THE INVENTION

Many known lath assemblies comprise corner caps which can be connected to the ends of two laths to provide a corner lath assembly. Lath assemblies with corner caps are often regarded by the public as visually non attractive. Mostly, the corner caps are made of plastic. A first problem is that many times the colour of the caps differ from the combined laths. Furthermore, after a while, the plastic corner caps decolour which further negatively affects the finishing performance. Such corner caps are for example known from KR101015001.

US2007/0125020 discloses in FIGS. 9 and 10, a trim molding system comprising a first and second trim piece which can be assembled to each other by an angled corner tab to obtain a mitre corner joint. The trim pieces have mitred edges. The angled corner tab is configured to fit into corresponding keyways formed in the trim pieces. When assembled, the trim pieces are pressed towards each other and meet at a joint angle defined by the angled corner tab. The tabs and keyways are jointed with a press fit, but can also be joined by using an adhesive or a fastener.

The disclosed trim molding system has a drawback in that the obtained joint is not satisfying. In some cases the joint is still noticeable by a small gap and the joint needs to be filled with putty, caulk, and adhesive to provide a better aesthetical appearance.

The general object of some embodiments of the present invention is to at least partially eliminate the above mentioned drawbacks and/or to provide a useable alternative. More specific, it is an object of the invention to provide a mitre corner assembly for forming a mitre connection which can be easily manually installed and provides an improved aesthetical appearance.

In some embodiments, this object may be achieved by a lath assembly as recited below.

The lath assembly according to some embodiments may be provided to obtain a finishing of a crossing of a sidewall and a floor or ceiling. The lath assembly may comprise a combination of at least a first and second lath. In some embodiments, the lath assembly comprises a pair of a first and a second lath. Each lath of the combination comprises a longitudinal body having a first end and a second end. The longitudinal body defines a longitudinal direction in a length direction. The longitudinal body has a first and second end face. The longitudinal body is provided with a keyway at its first end. The keyway forms a female part. The female part is configured to receive a male part of another component. The keyway has a keyway opening at the first end face. The lath assembly further comprises a connector for connecting the first ends of the pair of laths to each other. The connector comprises two key members to be inserted into the respective keyways of the laths to be connected. After establishing a connection, the first and second key members of the connector extend through the respective keyway openings at the end faces of the laths. Herewith, the connector is positioned at an inner side of the laths. After mounting the lath assembly to a sidewall only the outside of the lath assembly is visible which provides a smooth finishing of the sidewall with respect of a floor or ceiling.

The lath assembly may be improved in that each keyway of the combination of laths comprises a lath stopper and in that each key member comprises a key stopper. The key stopper is integrally formed with the key member. The lath stopper is integrally formed with the lath. The connector is one single piece including the two key members and the respective two key stoppers. Initially, in an unassembled condition in which the lath assembly has separate components, the lath assembly comprises a combination of laths and a separate connector. In an assembled condition, the laths are connected to each other by the connector. The key stopper is in an assembled condition in form closure with the lath stopper to lock the connector in the longitudinal direction to the lath.

The lath assembly herein may provide an advantage in that the engagement of the key stopper with the lath stopper provides a secure lockage of the connector to the lath in length direction. In stead of a friction based fastening by a press fit of the key member to the lath, the lath assembly according to the invention provides a geometrically closed connection by the engagement of the respective stoppers. The engagement of the key stopper and the lath stopper provide a form closure in length direction of the laths. Typically, in an assembled condition, the laths are connected to each other under a tensional force in longitudinal direction. Once the connection is established, the stoppers are in engagement and cannot be easily disconnected by the tensional force in the longitudinal direction which is present in the assembled condition. Herewith, a more secure connection is provided.

In an embodiment of the lath assembly according to the invention, the lath assembly provides in an assembled condition a 180° connection. In particular, the lath assembly is a corner lath assembly for a sidewall edge finishing of a floor or ceiling at a corner position. The corner lath assembly comprises two connected laths which provide in an assembled condition a corner angle. In particular, the lath assembly is a mitre corner assembly, in which the laths include at least one chamfered, ie angled, end to form a mitre corner angle. The corner lath assembly provides in an assembled condition an angled connection under a corner angle of at least 60°, in particular at least 90° and at most 300°, in particular at most 270°. An internal corner means a corner in which two sidewalls enclose an angle smaller than 180°, while an external corner means a corner in which two sidewalls enclose an angle larger than 180°.

In an embodiment of the lath assembly according to the invention, the longitudinal body of the lath defines a longitudinal direction, a length direction. The longitudinal body defines a longitudinal axis, which longitudinal axis extent in the longitudinal direction. The longitudinal body has a first and second pair of opposite sides which extend in the longitudinal direction. The first pair of opposite sides defines a back and front, also called outer and inner side. The second pair of the opposite sides defines a top and bottom side. When mounted to a sidewall, the back side of the lath is an inner surface of the lath which back side forms together with the bottom side of the lath a mounting surface for mounting the lath to a sidewall, floor or ceiling. The top and front side of the lath may have an ornamental appearance to provide a proper finishing work.

In an embodiment of the lath assembly according to the invention, the keyway of the lath has a receiving opening which is provided at the bottom surface of the lath. The receiving opening is configured to receive a key member of the connector. The connector is to be inserted into the receiving opening at the bottom side in a transversal direction with respect to the longitudinal direction.

Advantageously, the receiving opening at the bottom side of the lath provides a secure lockage of the connector to the lath which is less susceptible to existing tensional forces in the assembled condition. The connector is initially connected to the lath by a mounting movement which is traverse to the longitudinal direction. In an assembled condition, occurring tensional forces are directed in the longitudinal direction of the lath and hence act in a traverse direction with respect to the mounting movement connector which prevents in the assembled condition an undesired releasing of the connector from the lath.

In an embodiment of the lath assembly according to the invention, the keyway comprises a lath stopper including an elongated wall portion. In particular, the keyway comprises a slit as a lath stopper which slit extends in a transversal direction with respect to the longitudinal direction of the lath. The slit may be manufactured into lath by a milling operation onto the inner surface of the lath. Advantageously, the slit allows a mounting movement of an inserted connector in the transversal direction and provides a secure lockage of the connector in the longitudinal direction.

In an embodiment of the lath assembly according to the invention, each lath of the combination of laths has a chamfered first end face. The chamfered first end face is prefabricated. Prefabricated means that a cutting operation to obtain the chamfered first end face is performed in a factory. The lath assembly is delivered to a user including a lath having at least one chamfered end face. The prefabricated chamfered first end face is machined beforehand and makes a manual operation at a working area to obtain the chamfered first end face at the moment of assembling unnecessary. The already available prefabricated chamfered first end face provides an advantage for a user, because in practice it often appears to be difficult for many users to provide a smooth chamfered end face by themselves. Most of the times, a user is able to sew a lath to provide a right angled lath end face, but it appears to be quiet difficult to provide an inclined end face to a lath. Problems of sewing result to an askew angled end face or an outer surface of the lath which is damaged in a visible zone along a cutting line. A prefabricated chamfered end face prevents such troubles.

In an embodiment of the lath assembly according to the invention, a chamfered end face of a lath comprises a chamfer angle of at least 10°, in particular at least 22.5°, preferably about 45° to create a desired corner angle by a combination of at least two laths. Two laths having a chamfered end face of about 45° may be used to form a straight corner angle. Alternatively, a plurality of laths, e.g. four laths having a chamfered angle of about 22.5°, may be used to create a work around.

In an embodiment of the lath assembly according to the invention, the combination of laths comprises a first lath and a second lath, wherein each lath has a prefabricated chamfered first end face and a right angled second end face. In dependence of the direction of the chamfered first end face, the user assembles an internal or external mitre corner. Advantageously, a mitre corner connection can be formed by using the combination of laths without a sewing operation. A user will not experience the above mentioned disadvantages or sewing. A corner assembly can be provided quickly and further laths can be quickly mounted against a sidewall to extend the corner assembly. Preferably, the first and second lath are lengthened at a prefabricated length of at least 10 cm, in particular at least 20 cm, but preferably at least 30 cm to obtain a smooth and visual attractive corner assembly. Preferably, the first and second lath have a prefabricated length of at most 100 cm, preferably at most 50 cm. The prefabricated length of the lath is handsome and suffice to cover and compensate some irregularities at a sidewall. A user can simply connect the first lath to the second lath and place a further lath against a sidewall in abutting engagement with the right angled second end of respectively a first or second lath.

In an embodiment of the lath assembly according to the invention, each lath of a pair of laths has a chamfered first end face and a chamfered second end face, wherein the chamfered first end face of a lath is arranged in parallel with the chamfered second end face. With respect to a longitudinal axis of the first lath, the chamfered end faces of the first lath of the pair of laths are in mirror symmetry with the chamfered end faces of the second lath.

Advantageously, the pair of laths having parallel chamfered end faces is suitable to create selectively an internal or an external mitre corner. The chamfered end faces are prefabricated which advantageously makes a mitre sewing operation of a user redundant. A user may connect respectively a first end of the first lath with a second end of the second lath or a second end of the first end to a first end of the second lath to obtain selectively an internal or external mitre corner. Advantageously, whatever desired, the single pair of laths allows a user to create an internal or external mitre corner assembly. After determining which chamfered end faces are to be used to form the corner assembly, a user may cut the remaining chamfered ends from the lath to obtain right angled end faces which may provide a smooth connection with abutting laths.

In an embodiment of the lath assembly according to the invention, the laths are arranged as an ornamental lath. An ornamental lath has an outer surface which provides a decorative finishing, e.g. a smooth or wooden look-a-like finishing. The ornamental lath serves for a decorative finishing of a sidewall. In particular, the lath comprises a lath body of a soft wood, like MDF. The ornamental lath may have an inner body of soft wood which inner body is covered by a sheet material, in particular a plastic sheet material, to obtain a decorative finishing of the lath. The lath may be a floor lath, also called a plinth, to provide a finishing of a floor edge with respect to a sidewall. Alternatively, the lath may be a ceiling lath to provide a finishing of a ceiling edge with respect to a sidewall.

In an embodiment of the lath assembly according to the invention, the key member and the key stopper are rigidly connected to each other. A relative movement of the key stopper with respect to the key member is prohibited.

In an embodiment of the lath assembly according to the invention, a geometrical shape of the key member including the key stopper is configured to fit closely into a keyway including a lath stopper of a lath. Regarding a cross section, the geometrical shape of the key member including the key stopper may be substantially identical to the geometrical shape of the keyway including the lath stopper in which substantially identical means that small tolerances exist to fit the key member into the keyway. To obtain a connection of the connector to a lath, the rigid key member including the rigid key stopper is pressed into a keyway until the key stopper fits with the lath stopper. Preferably, the connector is slid into the keyway in a transverse direction with respect to the longitudinal direction of a lath. Advantageously, the rigid connection of the key stopper to the key member provides an opportunity for a user to disconnect the connector from the lath when it appears necessary. A user may unintentionally generate an internal corner assembly, while an external corner assembly is needed. In such a case, it may be an advantage to be able to easily disconnect the connector from the lath and reconnect the connector in another way again.

In an embodiment of the lath assembly according to the invention, the key member may have a geometrical shape which is configured to fit with an amount of play into a corresponding keyway. The key member is flexible which means that the key member is bendable during an introduction into the keyway. The amount of play in the keyway permits an elastic deformation of the key member during an introduction of the key member into the keyway. When the key member reaches its end position, the key stopper engages with a corresponding lath stopper by a snapping movement which provides a form closure of the key member in the keyway.

In an embodiment of the lath assembly according to the invention, the key stopper is resiliently connected to the key member. The key stopper may be a resilient portion of the key member. The resilient connection allows a relative movement of the key stopper with respect to the key member. The key stopper may be a snap portion of the key member which snaps in an assembled condition into a snap recess of a keyway which snap recess serves as a lath stopper. The resilient portion has a back position in which a prestress occurs and a snap position in which the prestress is at least partially eliminated. To get a connection of the connector to a lath, the resilient portion is held in the back position and may be pressed into a keyway of a lath. When entering the snap recess, the resilient portion will spring back into the snap position. Herewith, a lockage of the connector to the lath is achieved. The lockage is a once-only lockage which means that after the snap fit, the connector cannot be easily disconnected again. Advantageously, the snap fit is a clear indication to a user that a reliable connection is established.

In an embodiment of the lath assembly according to the invention, the keyway of the lath has a receiving opening which coincidences with the keyway opening at the end face. The receiving opening is provided at the end face of the lath. A connector is to be inserted into the receiving opening in a longitudinal direction of the lath. A snap connection may be provided to provide a form closure connection of the connector to the lath. Advantageously, a secure lockage is provided in an easy way.

In an embodiment of the lath assembly according to the invention, each key member comprises at least one key stopper. The at least one key stopper may be situated at an inner and/or outer surface of the key member. The key stopper may be formed by a protrusion which extends in a direction away from the inner or outer surface. In particular, the protrusion extends in a direction substantially perpendicular to the key member. The protrusion may have any geometrical shape which is suitable to withstand occurring tensional forces in an assembled condition of the lath assembly in which the forces are directed in a longitudinal direction of a lath. The protrusion may have e.g. a circular or longitudinal shape.

In an embodiment of the lath assembly according to the invention, the protrusion of the key stopper has a longitudinal shape, wherein the lath stopper comprises a corresponding longitudinal shape. The lath stopper and key stopper may have an elongated wall portion. The lath stopper may be formed by a slit in a keyway. In particular, the protrusion has a longitudinal shape which extends in a plane defined by a plate body of the key member in a direction which is in an assembled condition traverse to a longitudinal direction of a lath. Advantageously, the longitudinal shape of the key stopper and lath stopper provides a smooth distribution of introduced tensional forces in the assembled condition of the lath assembly. The smooth distribution prevents a depression of a stopper surface of a lath stopper which might result in an elimination of a pressing force and open gap at a mitre corner connection. Herewith, the protrusion as a key stopper is suitable to compensate tensional forces existing in the assembled condition, such that a possible gap in between two connected laths is closed by a pressing force.

In an embodiment of the lath assembly according to the invention, the first key member of the connector comprises an inner and an outer surface, wherein both inner and outer surface are provided with respectively an inner and outer key stopper. Preferably, both first and second key members are provided with an inner and outer key stopper. Both sides of the first key member are provided with a key stopper. In an assembled condition, tensional forces occur which are directed in a longitudinal direction of the lath. The key member which comprises at both sides a key stopper which provides advantageously and improved introduction of the tensional forces into the key member. The tensional forces are symmetrically introduced into the key member. Introduced tensional forces into the key member hardly generate a torque onto the key member which reduces bending forces and increases the reliability of the provided connection by the connector.

In an embodiment of the lath assembly according to the invention the key stopper comprises an upstanding wall portion having a substantially constant wall thickness. Advantageously, the connector can be easily produced into one piece by thermoforming.

In an embodiment of the local assembly according to the invention, the key member of the connector comprises a plate body, wherein the place body of the key member is rounded at an outer corner. A rounded corner provides an insertion portion to the key member. The corner of the key member may be rounded by a radius of at least 5 mm, in particular at least 10 mm, but preferably at least 15 mm. Advantageously, the rounded corner of the key member allows a more convenient insertion into a receiving opening of a keyway of a lath.

In an embodiment of the local assembly according to the invention, the inner and/or outer surface of the key member are textured. The textured surface may e.g. be ribbed. In stead of a smooth surface, the textured surface provide a rough surface which may improve a frictional engagement of the connector with the lath. In use, the improved frictional engagement may be convenient in a preparing step of mounting a lath assembly in which no final lockage is made. The preparing step can for example be performed to determine whether the lath assembly satisfies the needs of a user. The improved frictional engagement by the textured surfaces may prevent an undesired release of a lath assembly during the preparing step. If the lath assembly satisfies, the lath assembly can be locked in a subsequent step by engaging the key stopper with the lath stopper. Such an approach may especially be satisfying when the stoppers are arranged as a only-once lockage.

In an embodiment of the lath assembly according to the invention, the connector is an angled connector for providing an angled connection of two laths. In particular, the connection of the laths is a perpendicular connection. In particular, the angled connector comprises a first and second plate shaped key member. Each key member of the connector comprises a plate body, wherein the plate body defines a plane. The first and second plate body are angled connected to each other in which the second plate body defines a plane which extends in a direction under an acute angle with respect of a plane defined by the first plate body. The second key member extends in an angled, in particular substantially orthogonal, direction with respect to the first key member. Due to the plate shaped key members, the angled connector provides rigidity to assembled laths. The angled connector is suitable to connect upstanding laths, in particular plinths, along a sidewall.

In an embodiment of the lath assembly according to the invention, the connector is a flat connector for providing a connection of two laths which are flat positioned in one common plane. The flat connector is suitable to connect flat positioned floor laths, also called cover plinths, or ceiling laths to each other. Flat positioned means that the lath which has a length, height and width is a flat lath having a smaller height than width, in which the width of the flat lath is positioned in a plane. A mounting surface of the flat lath is provided in width direction. The flat connector is a planar connector. The flat connector has a plate shape connector body. The plate shaped connector body comprises two key members. The two key members are aligned with each other in one common plane. The flat connector has two key members which have each at least one snap fit key stopper. The key member of the flat connector is introducible into a keyway of a lath until the key stopper snaps into a lath stopper.

In an embodiment of the lath assembly according to the invention, the lath assembly further comprises mounting means, in particular a mounting clip, for mounting a lath to a sidewall. Advantageously, a user has a complete package for providing a smooth lath connection and for subsequently mounting the lath assembly in an assembled condition to a sidewall.

Further embodiments are defined in the subclaims.

Further, the invention relates to a sidewall finishing lath assembly. The sidewall finishing lath assembly may be a ceiling package or floor package comprising components to provide a sidewall finishing of a ceiling respectively a floor.

Further, features described herein relate to a building having at least one room, which room comprises at least one sidewall and a floor or ceiling, wherein the building further comprises a lath assembly according to the invention. The lath assembly is connected in the assembled condition to the sidewall. The lath assembly is provided to obtain a smooth finishing of the floor and/or ceiling with respect to the sidewall.

Further, features described herein relate to a method for providing a lath assembly, in particular a mitre corner assembly, at a sidewall. In particular, the lath assembly is formed by connecting two laths by one connector. Just three components may be sufficient to create a lath assembly which provides a visually attractive finishing of a floor or ceiling edge to a sidewall. Two laths maybe connected to each other by only one component, the connector.

In a first step of the method according to an embodiment of the invention a local assembly according to the invention is provided which comprises a connector and a combination of laths, which combination has at least a pair of a first and second lath. The connector is provided with a first and second key member.

In a subsequent step of the method, the first key member of the connector is inserted into the receiving opening of a keyway of the first lath to obtain a locking engagement of the first key member with the first lath. The first key member has a first key stopper which engages with a first lath stopper of the first lath.

In a subsequent step of the method, the second key member of the connector is inserted into a receiving opening of a keyway of the second lot to obtain a locking engagement of the second key member with the second lath. The second key member has a second key stopper which engages with a second lath stopper of the second lath.

In a step of the method, the first and second lath are moved in and putting engagement to each other to obtain a lath connection. Due to the engagement of the key stoppers with the lath stoppers, the lath connection is locked and secure. After establishing the lath connection, the lath assembly is placed against a sidewall of the room. The lath assembly can be mounted to the sidewall by a mounting means to obtain a smooth finishing of a floor or ceiling edge with respect to the sidewall. In particular, the lath assembly is snapped onto a mounting clip which is attachable to a sidewall to mount the lath assembly to the sidewall.

In an embodiment of the method according to the invention, the first and second laths are moved along each other, in particular slid along the first end faces of the laths, in a transversal direction with respect to a longitudinal direction of the lath to obtain the lath connection. As explained above, the traverse mounting movement contributes advantageously to a more secure lockage. The assembly connection will remain durable closed.

In an alternative embodiment of the method according to the invention, the first ends of the first and second laths may be moved towards each other in a longitudinal direction to obtain an abutting engagement of the laths. The connector may be inserted into a keyway which has a receiving opening at the first end face which coincidences with the keyway opening and extends in the longitudinal direction. The secure lockage of the connector to the lath may be provided by a snap fit.

The invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the appended claims, in which:

DETAILED DESCRIPTION

Identical reference numbers are used in the figures to identify identical or similar components.

Figure 1A:
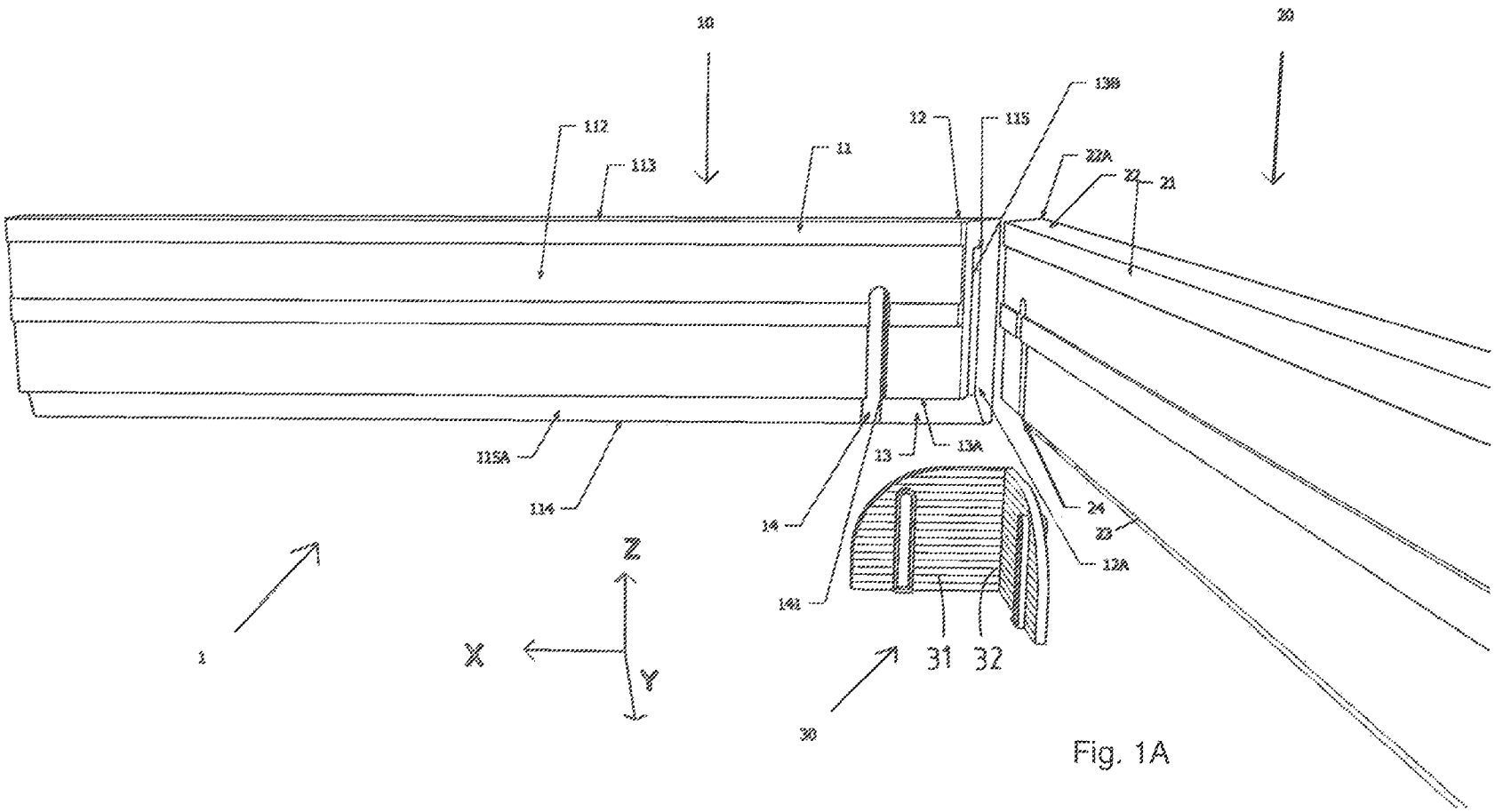
FIG. 1A-D show in a perspective view a connection of a lath assembly according to the invention.

FIG. 1A shows in an exploded view in perspective a lath assembly 1 according to an embodiment of the invention. The lath assembly 1 is illustrated in a unassembled condition, in which the several components of the lath assembly are separated from each other. The lath assembly 1 consists of two laths 10,20 and one connector 30. The lath assembly 1 is an ornamental lath assembly. The lath assembly 1 is provided to obtain a decorative finishing of a floor or ceiling with respect to a sidewall.

A floor or ceiling can be considered as a room panel which is positioned adjacent to a sidewall. The lath assembly is arranged to at least partially extend along a circumferential edge of the room panel. In a room, the room panel defines a substantially horizontal plane, in which the sidewall extend in a substantially vertical plane. In an assembled condition and when positioned at a sidewall, the laths of the lath assembly extend in a horizontal direction in a horizontal plane. In an application of the lath assembly, a gap may exist in between the room panel and the sidewall. The gap may be covered by a lath of the lath assembly according to the invention to get a proper finishing.

The lath assembly comprises a combination of at least a first lath 10 and a second lath 20. A serial connection of laths may be provided to obtain a complete corner assembly. To provide a floor-sidewall finishing, the combination of laths may comprise a pair of floor laths, in particular a pair of plinths. To provide a ceiling-sidewall finishing, the combination may comprise a pair of ceiling laths. In an assembled condition, the lath assembly may be directed in a horizontal direction and placed in an upstanding or flat position.

Figure 1B:
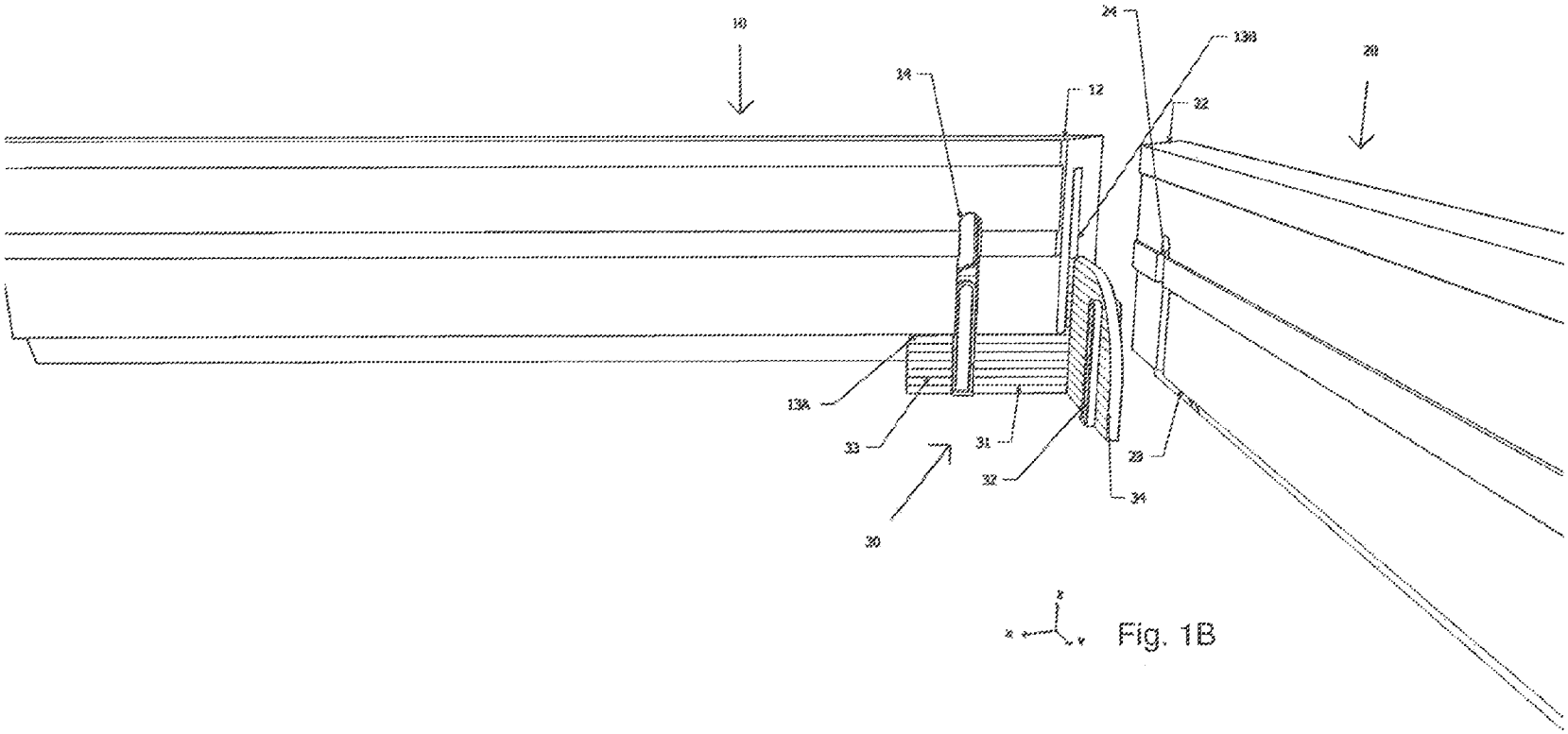
Figure 1C:
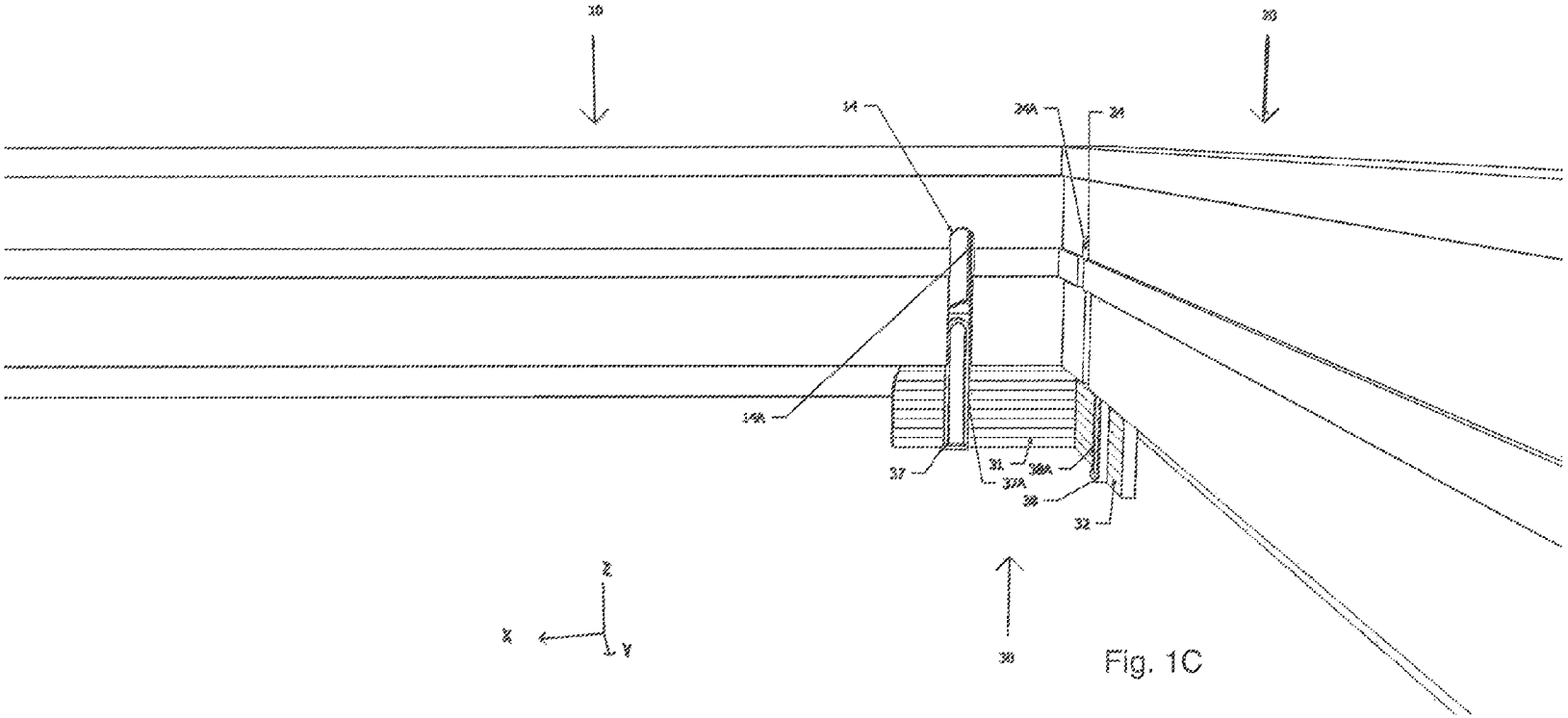

FIG. 1A-C shows the lath assembly from an inside point of view. The first and second laths are connectable to each other. The first and second lath 10,20 form a pair of laths. Each lath has a longitudinal body 11,21. The longitudinal body 11,21 may be made of a softwood, in particular an MDF-material.

The longitudinal body 11 has a length, width and height. Typically, the width of a lath is smaller than the height. Occasionally, a lath may have a width which is equal to a height. The longitudinal body 11 has a front, back, top and bottom side 111,112,113,114.

As shown in FIG. 1A-D, a first longitudinal body 11 of the first lath 10 defines a longitudinal direction in a x-direction. A second longitudinal body 12 of the second lath 20 defines a longitudinal direction in an y-direction. The lath assembly is positioned in an x-y plane, a horizontal plane. A direction traverse to the longitudinal direction is oriented in a z-direction, a vertical direction.

In FIG. 1A-D, the lath assembly is depicted in upstanding position. The front and back side extend in longitudinal and height direction. The front and back side extend in an x-z or y-z plane. The bottom and top side extend in longitudinal and width direction. The bottom and top side are arranged in parallel with an x-y plane. The bottom and back sides form a mounting surface of the lath. The back and bottom side of the lath serve to mount the lath against a sidewall and a room panel, such that the back and bottom sides are not visible after mounting the lath. After mounting a lath to a sidewall, the front and top sides form the outside of the lath. The front and top side provide a sidewall finishing. The front and top sides are visible after mounting the lath to a sidewall. The front and top sides form a finishing surface of the lath. The front and top side of the lath may comprise a finishing layer. Preferably, the finishing layer is decorative. The finishing layer may be provided by a cover sheet which is connected to the longitudinal body to cover the top and front surface. In particular, the cover sheet is a plastic sheet, wherein the plastic sheet is connected to a MDF longitudinal body.

The pair of laths are connectable to each other to obtain a straight or angled lath assembly. The illustrated lath assembly in FIG. 1 is provided to obtain an angled corner assembly. The angled corner assembly is here a straight angled corner assembly which extends in an x-y plane. The shown angled joint is an external corner assembly. In an external corner assembly, an angle in between the outer sides 111, 211 of two paired laths is larger than 180°, in particular about 270°. Alternatively, the angled corner assembly may be configured as an internal corner assembly in which the angle in between the outer sides 111, 211 of two paired laths is smaller than 180°, in particular about 90°.

The longitudinal body 11,21 has a first end 12, 22 which is configured to make a connection to another first end of another lath. The longitudinal body 11,21 has a first end face 12A,22A. The longitudinal body 11 comprises an inner space 115. The inner space is a slot which extends about the whole length of the lath. The inner space is open from the bottom surface 114 of the lath. The inner space has a substantially rectangular cross section. The inner space may be manufactured by a milling operation from the bottom surface of the lath. The inner space 115 may be configured to receive a mounting clip to mount the lath to a sidewall. In mounting the lath assembly to a sidewall, a user may first mount a mounting clip to the sidewall and subsequently snap the lath to the mounting clip. The configuration of the inner space 115 and use of a mounting clip prevents visible mounting means from an outside point of view to the lath, which contributes to the ornamental function. The inner space 115 may further comprise a cable channel for guiding an electrical cable. The cable channel 115*a* may be positioned at the bottom surface of the lath.

The inner space 115 comprises a keyway 13. An open chamber at the first end of the inner space forms the keyway 13. Herewith, the longitudinal body 11,21 comprises a keyway 13,23 at the first end 11,21. The keyway is configured to receive a connector 30. The keyway 13 forms a female part which is configured to receive a male part of the connector 30. The inner geometry of the keyway is complementary to the outer geometry of the male part of the connector. The keyway 13 has a receiving opening 13A for receiving the connector 30. The receiving opening is positioned at the bottom side to receive a connector 30 from beneath in z-direction. The keyway 13 has a keyway opening 13B at the end face 12A of the lath. The keyway opening 13B extends in a direction substantially perpendicular to the receiving opening 13A of the keyway 13. In the assembled condition, the lath assembly 1 comprises two laths 10,20 which are positioned in an abutting engagement with each other. The respective first end faces 12A, 22A are positioned against each other. In the assembled condition, the keyway openings 13B, 23B of the first and second lath are positioned opposite each other. The first and second keyway openings 13B and 23B are aligned with each other. After mounting the connector 30, the connector 30 extends from the first keyway 13 through both keyway openings 13B, 23B to the second keyway 23 to provide the secure connection.

Figure 1D:
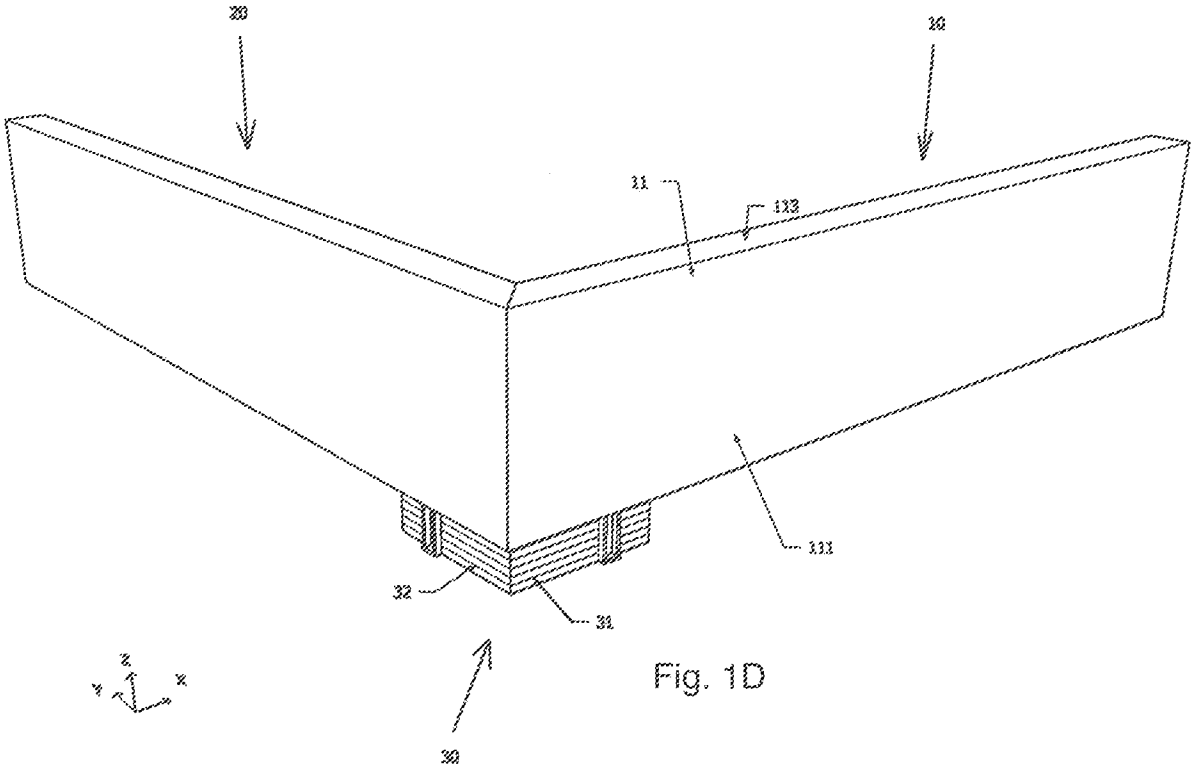

Further, the lath assembly 1 comprises a connector 30 for connecting the first ends 11,21 of the pair of laths 10,20 to each other. The connector 30 is arranged to be inserted into the first and second keyways 13, 23. As illustrated in FIG. 1B-D, the connector 30 has to be inserted into the keyway 13, 23 from a bottom side of the lath to assemble the laths 10,20. The connector 30 is an insertion connector which means that the connector is positioned inside the lath. The keyway is an internal positioned keyway. The insertion connector 30 is not visible from the outside of the lath assembly after a complete insertion. In an assembled condition, the connector 30 is received in the respective keyways 13, 23 in which the connector is enclosed by the respective laths.

FIG. 1B represents a first step of the method according to the invention showing a partial introduction of the connector 30 into a first keyway 13 of the first lath 10. The connector 30 comprises two key members 31,32 which are arranged to be inserted into the respective keyways 13, 23 of the pair of laths. The connector is shown in further detail in FIG. 2. The lath 10 is provided with a lath stopper 14. The lath stopper 14 cooperates with the key stopper 37 of the connector 30. The lath stopper 14 is formed by an elongated wall portion of a slit 14 which extends in a direction traverse to the longitudinal direction. The slit extends from the bottom side of the lath in z-direction. The slit is open at the bottom side to receive a key stopper from beneath. The slit is manufactured by a milling operation starting from the inner side of the lath. Seen in the traverse direction, the slit provides from the inner side a through passage to the keyway. Preferably, the slit has a slit depth which extends from the inner side beyond the keyway. Herewith, the keyway 13 is provided with two slits at both sides of the keyway. The keyway is provided with two lath stoppers 141,142 to receive a key member 31 with two key stoppers 371, 372 at both sides of the key member.

Figure 2A:
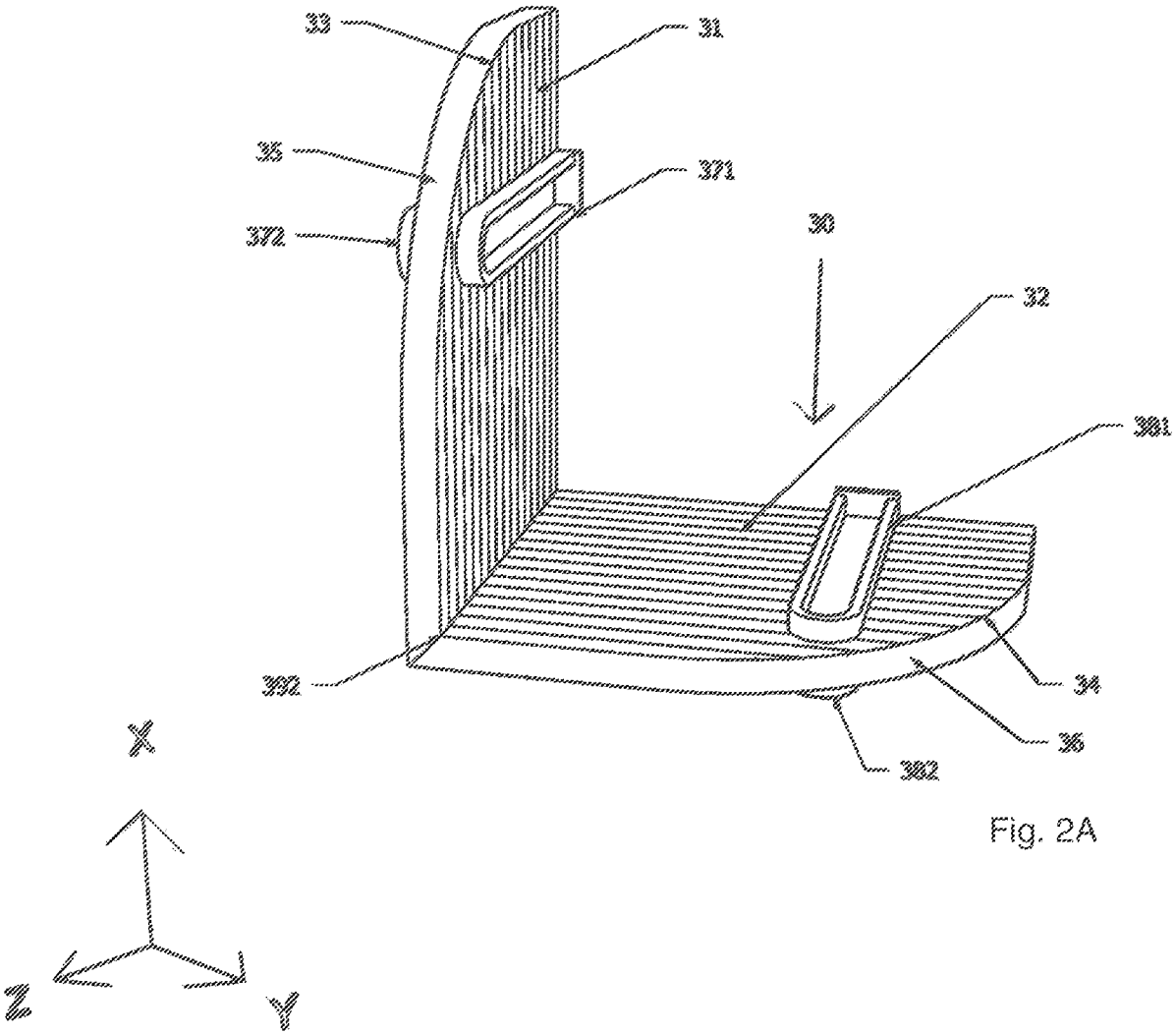
FIG. 2A-D show in several views an angled connector for mounting a lath assembly according to the invention.

As further shown in FIG. 2A, the key member 31 comprises a protrusion as a key stopper 37, which is complementary formed to the lath stopper 14. The protrusion has a longitudinal shape. During the introduction of the key member 31 into the keyway 13, the protrusion moves into the slit.

FIG. 1C represents a next step of the method according to the invention showing a partial introduction of the connector 30 into the second keyway 23 of the second lath 20. Both laths 10, 20 are partly slid over the connector 30 and aligned with each other. The connector 30 is introduced in both keyways 13, 23 via the receiving opening 13A, 23A. The key member 31 extends through the keyway opening 13B. During the introduction of the connector 30, both laths 10, 20 are in abutting engagement with each other. The first mitred end faces of the laths 10, 20 are in abutting engagement with each other. The laths 10, 20 are kept in position in longitudinal direction by the lath stopper 14, 24 and the key stopper 37,38. The stoppers have a longitudinal shape. Each stopper have a stopper surface. The key stoppers have an elongated wall portion 37A, 38A which provide a stopper surface. The lath stoppers have an elongated wall portion 14A, 24A. The elongated wall portion 14A, 24A extends in a direction traverse to the longitudinal direction of the lath 10,20. The elongated wall portions 14A,24A are spaced from the first end faces 12A, 22A at a distance of at least 5 mm, in particular at least 10 mm, preferably at least 15 mm to provide a strong assembly of the laths. During a further introduction of the connector 30 into the keyways, the first end face of the laths 10, 20 are kept in position which finally results in a smooth lath connection. After providing the connection, the lath assembly can be mounted to a sidewall.

FIG. 1D shows the lath assembly as shown in FIG. 1C from an opposite point of view. The lath assembly is shown from an outside point of view, which outside is visible after mounting the lath assembly to a sidewall. FIG. 1D shows the finishing surface of the lath assembly. The outer and top surface of the lath assembly are visible. The lath assembly provides a smooth finishing. No mounting means are visible and an undesired gap at the mitre corner joint is prevented by the internal positioned connector.

FIG. 2A-D show in several views a connector 30 of the lath assembly according to the invention. The connector 30 is an angled connector 30. The connector 30 has two key members 31, 32 which are angled, substantially perpendicular, connected to each other. The first key member 31 has a plate shaped body which defines a first plane. The second key member 32 has a plate shaped body which defines a second plane. The first and second plane are oriented substantially perpendicular. The connector 30 has an outer and inner corner edge 391, 392 at the intersection of the first and second key member 31, 32. The outer corner edge is oriented in a z-direction. In an assembled condition, the outer and inner corner edge 391, 392 extend in a traverse direction of the connected laths.

Each key member 31, 32 has a key stopper 37, 38 at both an inner side and an outer side. The first key member 31 has a key stopper 371 at an inner side and a key stopper 372 at an outer side. The second key member 32 has a key stopper 381 at an inner side and a key stopper 382 had an outer side.

The key stopper 37, 38 is formed by a protrusion. The protrusion extends away from the plate shaped key member 31, 32. The protrusion is elongated. The protrusion has an elongated wall portion 37A. The protrusion comprises at least one straight wall portion 37A, which is rounded at one end. The straight wall portion is provided for an equal distribution of introduced forces in an assembled lath assembly. Here, two straight wall portions are closed by a rounded wall portion. The rounded wall portion is provided for a smooth introduction into lath stopper. The protrusion is integrally formed with the key member by a molding operation. The key member 31 and key stopper 37 are formed in one piece.

To improve a convenient introduction of the key members 31, 32 into the respective keyways 13,23, the key members are provided with a rounded outer corner 35,36. The outer corner is rounded with a radius of at least 5 mm to obtain a smooth introduction of the key member into a keyway.

Figure 2B:
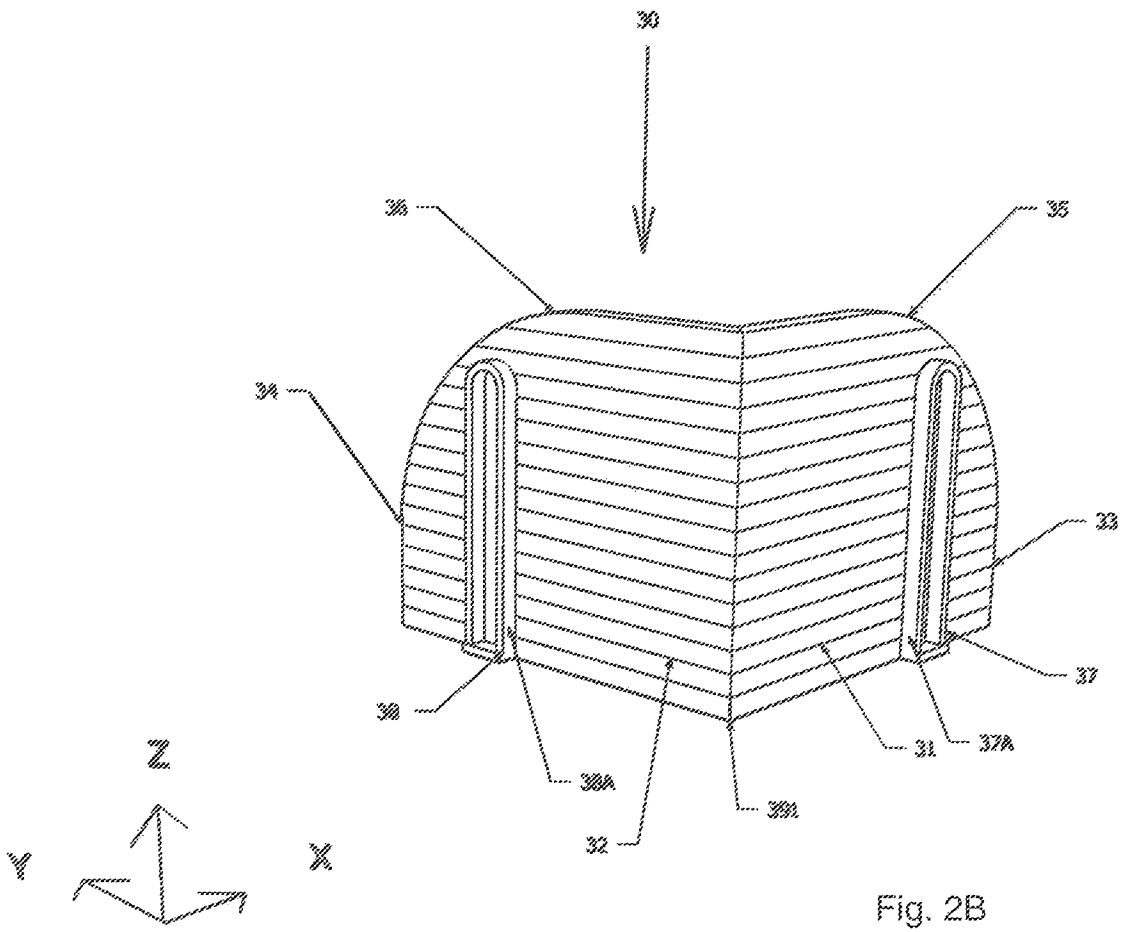
Figure 2C:
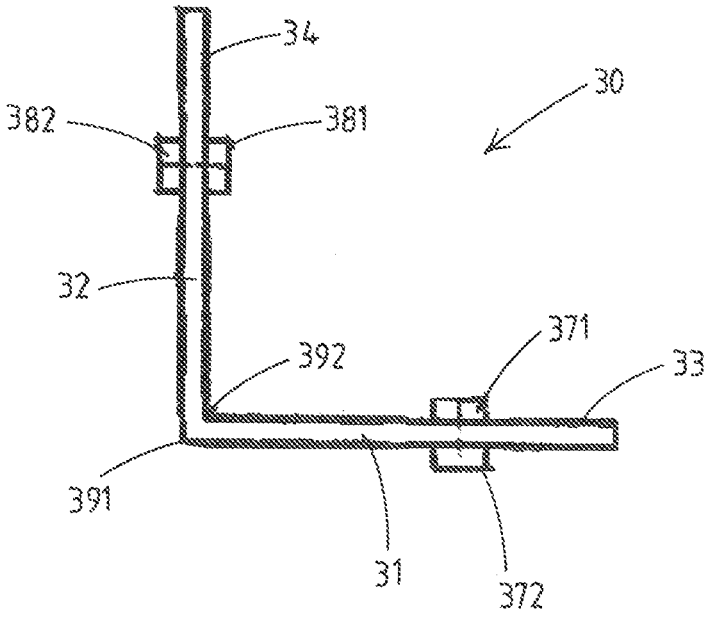
Figure 2D:
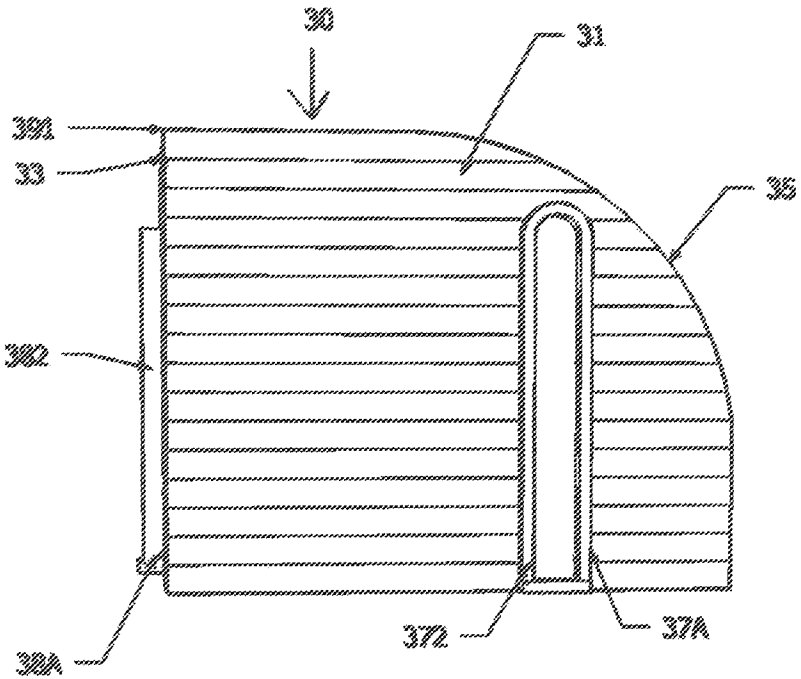

As shown in FIGS. 2A and 2B, the key members have a rough, preferably ribbed, outer surface. The outer surface comprises at least one rib 33, 34 having a height of at least 0.2 mm and at most 1 mm. The at least one rib 33, 34 extends in a direction perpendicular to the corner edge 391, 392. The at least one rib extends in an assembled condition of the lath assembly in the longitudinal direction of a lath. The orientation of the at least one rib is defined perpendicular to an insertion direction of the connector 30. During an insertion of the connector 30, the rough outer surface of the key member 31 gets in contact with a wall portion of the keyway 13 which provides an improved grip to prevent an early loosening of the connector 30 during a mounting of the lath assembly to a sidewall.

Figure 3A:
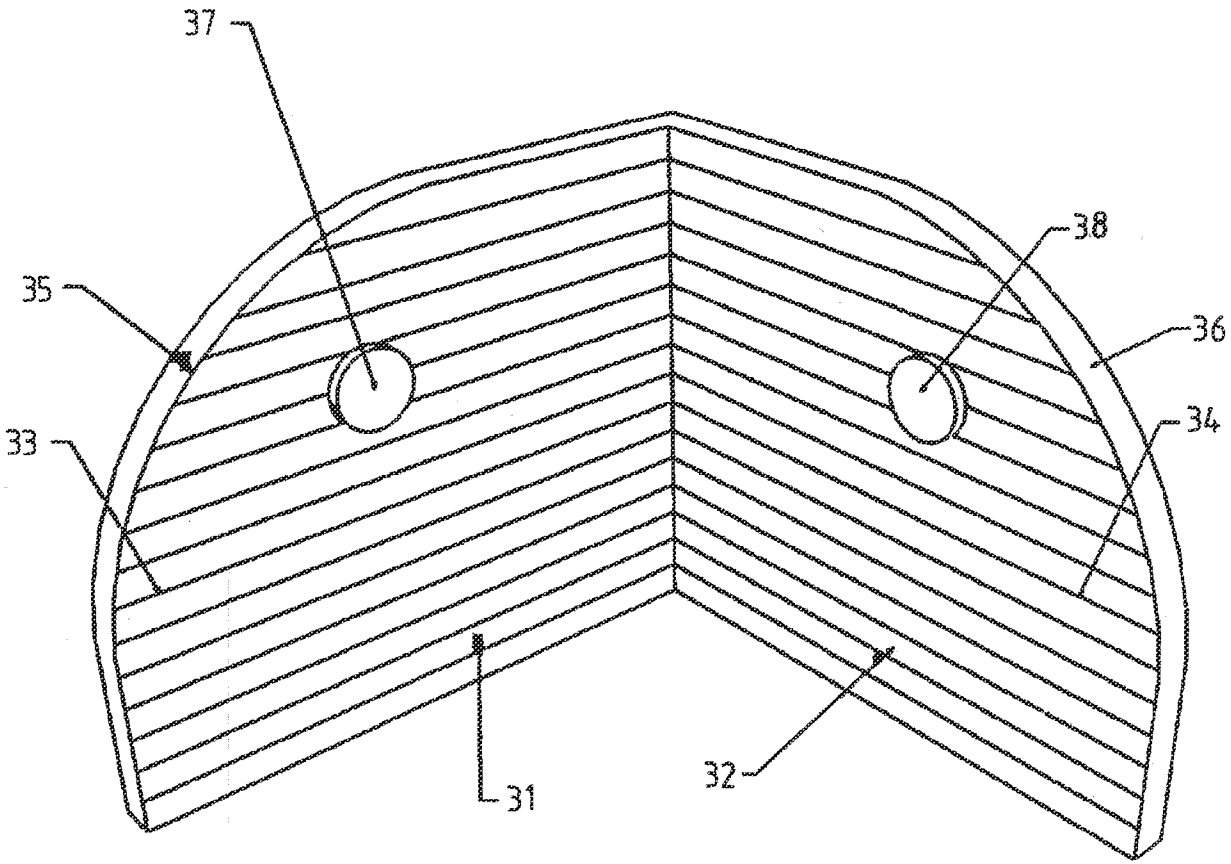
FIG. 3A-D show in several perspective views an angled connector and a pair of laths having a snap-fit configuration of a key and lath stopper.

FIG. 3A shows an alternative embodiment of a connector 30. The connector 30 has at least one key stopper 37, 38 which has a circular shape. The key stopper is a circular protrusion which extends away from a plate shaped key member. The key stopper 37 can be moved into an elongated lath stopper as shown in FIG. 1 which may be formed as a slit.

Figure 3B:
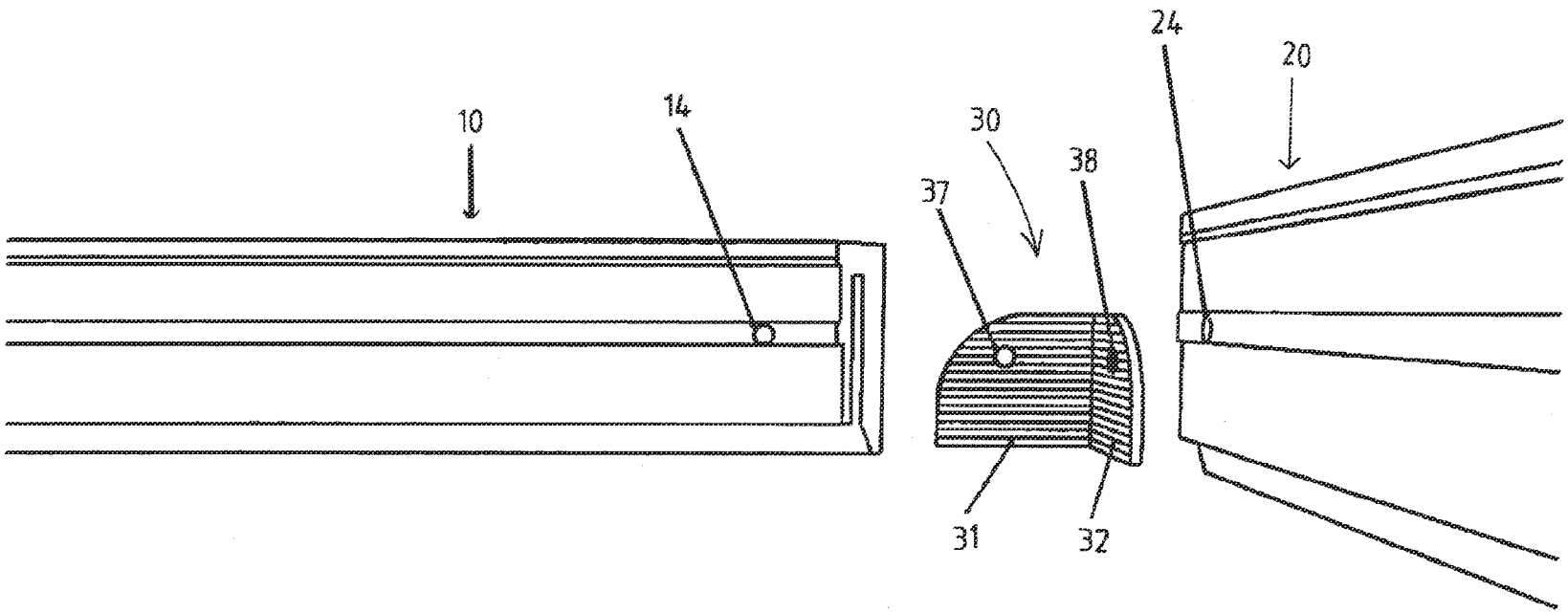

FIG. 3B shows an alternative embodiment of the lath stopper 14,24. The lath stopper is a bore hole. The lath stopper has a circular shape in cross section. To provide a secure form closed connection of the connector 30 to the lath 10,20, the connector 30 is connected by a snap fit to the lath 10, 20. The connector 30 comprises two key members 31, 32 which are flexible with respect to each other. The key members 31, 32 are flexible, such that the two key members deform elastically when introduced in a keyway 13 of a lath 10 until the key stopper snaps into the lath stopper.

Figure 3C:
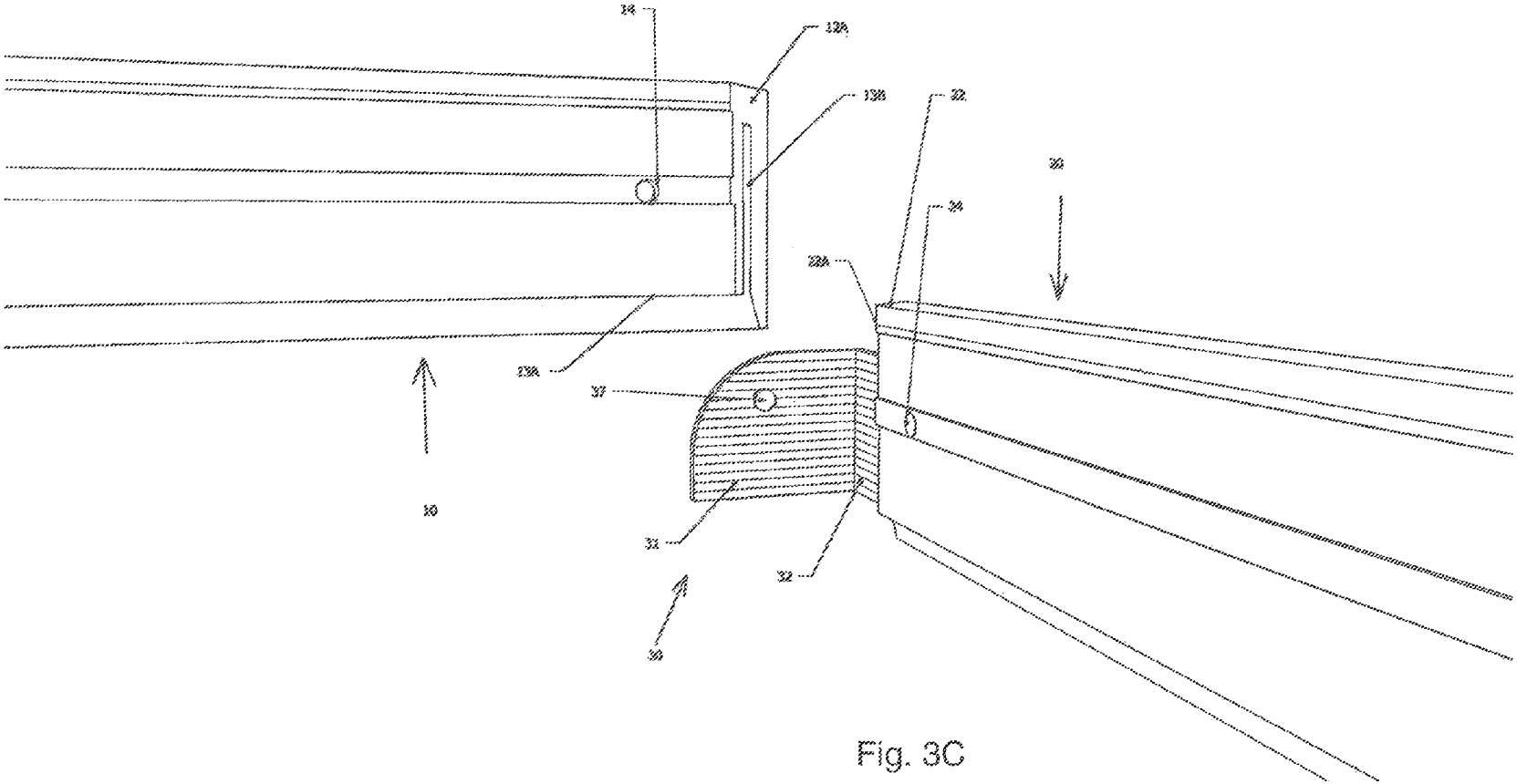

In the shown embodiment of FIG. 3C, a key member may be selectively introducible in a receiving opening provided at a bottom side of the lath or provided at an end face of the lath. The key member may be introduced under an introduction angle into the keyway. The key stopper of the key member snaps into the lath stopper when the key member is introduced sufficient far into the keyway.

FIG. 3C shows at a right side of the perspective view an introduction of a key member 32 into a keyway 23 which has a receiving opening 23A at an end face 22A of the lath 20. The key member 30 is introduced into the receiving opening 22A in a longitudinal direction of the lath 20.

FIG. 3C shows at a left side of the perspective view an introduction of a key member 31 into a keyway 23 which has a receiving opening 13A at a bottom side of the lath 20. The key member 30 is introduced into the receiving opening 22A in a traverse direction of the lath 10.

Figure 3D:
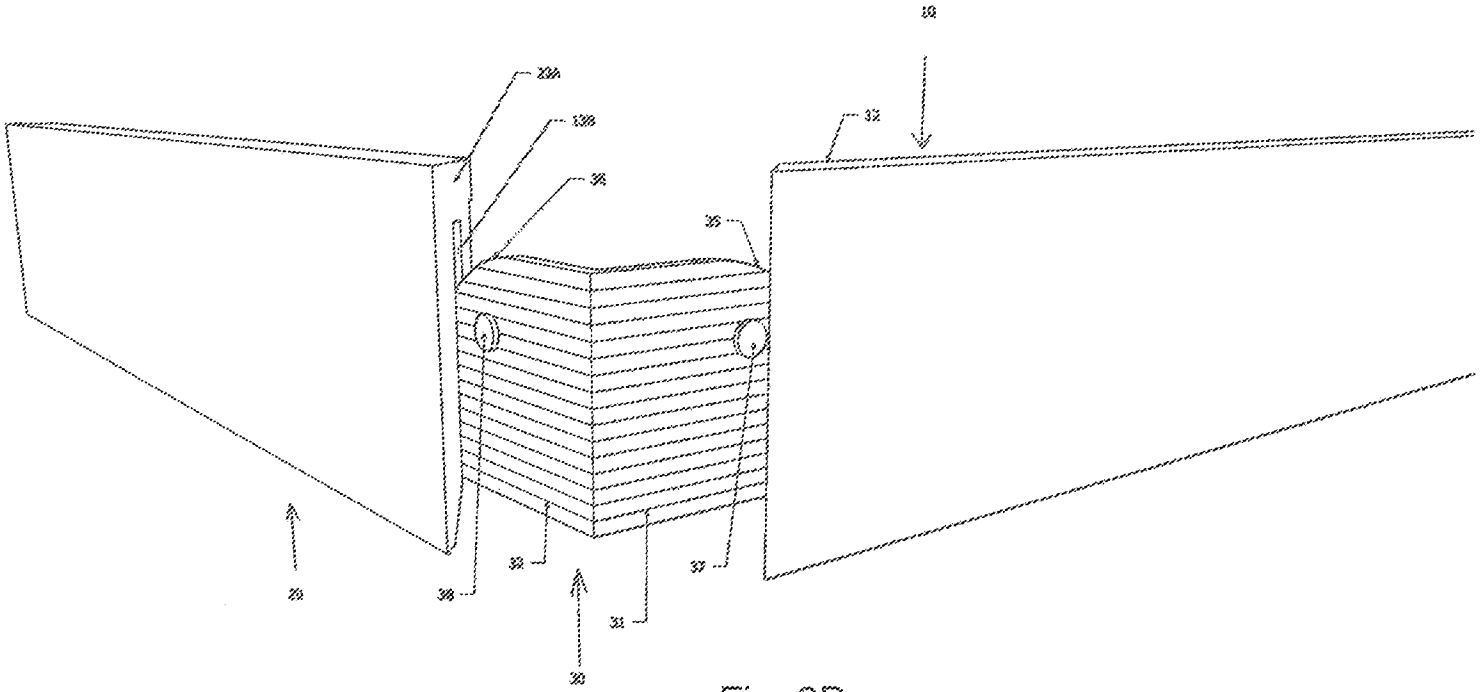

FIG. 3D shows in an perspective view, the lath assembly from an outside point of view. The lath assembly has a smooth outer side which is free from irregularities. The lath stoppers are not visible from the outside. The connector 30 is an insertion connector 30 which is in an assembled condition completely received inside the lath assembly, such that the connector 30 is not visible from the outside.

Although features above have been disclosed with reference to particular embodiments, from reading this description those of skilled in the art may appreciate a change or modification that may be possible from a technical point of view but which do not depart from the scope of the invention as described above and claimed hereafter. Modifications may be made to adapt a particular situation or material to the teachings of the invention without departing from the essential scope thereof. It will be understood by those of skilled in the art that various changes may be made and equivalents may be substituted for elements thereof without departing from the scope of the invention. Therefore, it is intended that the invention is not limited to the particular embodiments disclosed in the above detailed description, but that the invention will include all embodiments falling within the scope of the appended claims.

It is remarked that any feature of the lath assembly according to the invention which is described in the embodiments and/or mentioned in the dependent claims is in itself considered patentable in independent. In particular, any measure presented in a dependent claim is also considered patentable without dependency of the independent claim.

Thus, the disclosure provides a lath assembly and method for forming a lath assembly which provides a secure and simple lockage of two laths. The secure lockage prevents a gap at a joint of two laths. Advantageously, the lath assembly is further convenient in use and enables a smooth and visual attractive finishing of a floor or ceiling edge with respect to a sidewall.

The invention claimed is:

1. A lath assembly for a sidewall finishing of a floor or ceiling comprising a combination of at least a first and a second lath, in which each lath comprises a longitudinal body defining a longitudinal direction, wherein the longitudinal body has a first end having a first end face, wherein the first end is provided with a keyway forming a female part, wherein the keyway has a keyway opening at the first end face; and a connector for connecting the first ends of the first and second laths to each other, wherein the connector comprises two key members forming two male parts to be inserted into the respective keyway of the laths to be connected, such that the key member extends through the keyway opening, wherein each keyway of the pair of laths comprises a lath stopper, wherein the lath stopper is integrally formed with the lath and in that each key member comprises a key stopper, wherein the key stopper is integrally formed with the key member, and wherein the key stopper is in an assembled condition of the lath assembly in form closure with the lath stopper to lock the connector in the longitudinal direction to the lath, wherein the longitudinal body has a front, back, top and bottom side along a longitudinal axis, which longitudinal axis extends in the longitudinal direction, wherein the keyway of the lath has a receiving opening which is provided at the bottom side of the lath, such that the connector is to be inserted into the receiving opening in a transversal direction with respect to the longitudinal direction of the lath.

2. The lath assembly according to claim 1, wherein the keyway comprises an elongated wall portion as a lath stopper which wall portion extends in a traversal direction with respect to the longitudinal direction of the lath.

3. The lath assembly according to claim 1, wherein the lath assembly is a mitre corner assembly, in which each lath includes at least one prefabricated chamfered end face to form a mitre corner angle.

4. The lath assembly according to claim 3, wherein each lath has a prefabricated chamfered first end face and a prefabricated right angled second end face.

5. The lath assembly according to claim 3, wherein each lath has a chamfered first end face and a chamfered second end face, wherein the chamfered first end face is in parallel with the chamfered second end face, wherein the chamfered end faces of the first lath of a pair of laths are arranged in mirror symmetry about a longitudinal axis of the first lath with respect to the chamfered end faces of the second lath, such that the pair of the first and second lath allows selectively an internal or external mitre corner assembly.

6. The lath assembly according to claim 1, wherein the key members and their corresponding key stoppers are rigidly connected to each other.

7. The lath assembly according to claim 1, wherein the key stoppers are each resiliently connected to a corresponding key member.

8. The lath assembly according to claim 1, wherein the key members of the connector each comprise a plate body, wherein the plate body defines a plane, and wherein the key stopper comprises a protrusion which extends in a direction away from the plane.

9. The lath assembly according to claim 8, wherein the protrusion of the key stopper has a longitudinal shape and wherein the lath stopper comprises a corresponding longitudinal shape of an elongated wall portion of a slit.

10. The lath assembly according to claim 1, wherein a first one of the key members of the connector comprises an inner and an outer surface, wherein the inner and outer surface are provided with respectively an inner and outer key stopper.

11. The lath assembly according to claim 1, wherein the key members of the connector each comprise a plate body that is rounded at an outer corner.

12. The lath assembly according to claim 1, wherein the connector is an angled connector for providing an angled connection of two upstanding laths, wherein the angled connector comprises a first and second plate shaped key member, wherein each key member comprises a plate body, which defines a plane, and wherein the first and second plate body are angled connected to each other wherein the second plate body defines a plane which extends in a direction under an acute angle with respect of a plane defined by the first plate body.

13. The lath assembly according to claim 1, wherein the connector is a flat connector for providing a connection of two flat laths which are flat positioned in one common plane.

14. The lath assembly according to claim 1, wherein the lath assembly further comprises a mounting clip configured to mount the lath assembly in the assembled condition to a sidewall.

15. The lath assembly of claim 1, wherein the first and second laths each comprise a keyway provided with a lath stopper for a cooperation with a key stopper of a connector.

16. A method for forming a lath assembly at a sidewall, comprising the following steps:

in a lath assembly comprising a combination of a first and second lath and a connector, wherein the connector is provided with a first and a second key member;

inserting the first key member of the connector into a receiving opening of a keyway of the first lath to obtain a form closure of the first key member with the first lath, wherein a first key stopper engages with a first lath stopper, and wherein inserting the first key member is in a direction orthogonal to a longitudinal axis of the first lath;

inserting the second key member of the connector into a receiving opening of a keyway of the second lath to obtain a form closure of the second key member with the second lath, wherein a second key stopper engages with a second lath stopper, and wherein inserting the second key member is in a direction orthogonal to a longitudinal axis of the second lath;

moving the first and second lath in abutting engagement to each other to obtain a lath connection; and placing the lath assembly in an assembled condition against a sidewall of a room.

17. The method according to claim 16, wherein the first and second laths each have a receiving opening at a bottom side of the lath for receiving the connector and wherein the laths are moved in a transversal direction with respect to a longitudinal direction of the lath about the connector to obtain the lath connection.

18. The method according to claim 16, wherein each of the first and second laths has a respective first end face having a keyway with a receiving opening that extends into a longitudinal direction, wherein the first ends of the first and second laths are moved towards each other in a longitudinal direction to obtain an abutting engagement of the laths.

19. A method for forming a lath assembly at a sidewall, comprising the following steps:

in a lath assembly comprising a combination of a first and second lath and a connector, wherein the connector is provided with a first and a second key member;

inserting the first key member of the connector into a receiving opening of a keyway of the first lath to obtain a form closure of the first key member with the first lath, wherein a first key stopper of the first key member engages with a first lath stopper of the first lath in a snap connection locking movement in a longitudinal direction of the first lath;

inserting the second key member of the connector into a receiving opening of a keyway of the second lath to obtain a form closure of the second key member with the second lath, wherein a first key stopper of the second key member engages with a first lath stopper of the second lath in a snap connection locking movement in a longitudinal direction of the second lath;

moving the first and second lath in abutting engagement to each other to obtain a lath connection; and placing the lath assembly in an assembled condition against a sidewall of a room.

20. A lath assembly for a sidewall finishing of a floor or ceiling comprising a combination of at least a first and a second lath, in which each lath comprises a longitudinal body defining a longitudinal direction, wherein the longitudinal body has a first end having a first end face, wherein the first end is provided with a keyway forming a female part, wherein the keyway has a keyway opening at the first end face; and a connector for connecting the first ends of the first and second laths to each other, wherein the connector comprises two key members forming two male parts to be inserted into the respective keyway of the laths to be connected, such that the key member extends through the keyway opening, wherein each keyway of the pair of laths comprises a lath stopper, wherein the lath stopper is integrally formed with the lath and in that each key member comprises a key stopper, wherein the key stopper is integrally formed with the key member, and wherein the key stopper is in an assembled condition of the lath assembly in form closure with the lath stopper in a snap connection to lock the connector in the longitudinal direction to the lath, and is resiliently connected to a corresponding key member, and wherein the longitudinal body of each lath has a front, back, top and bottom side along a longitudinal axis, which longitudinal axis extend in the longitudinal direction, wherein the keyways of the laths each have a receiving opening which coincidences with the keyway opening at the end face of the corresponding lath, such that the connector is to be inserted into the receiving opening in a longitudinal direction of the lath.

21. The lath assembly of claim 20, wherein the key stoppers are each resiliently connected to a corresponding key member.

* * * * *